US006067889A

United States Patent [19]

Brown

[11] Patent Number: 6,067,889

[45] Date of Patent: May 30, 2000

[54] PORTABLE COMBAT BUNKER

[76] Inventor: James C. Brown, 2121 Skyhawk Dr., Fort Wayne, Ind. 46815

[21] Appl. No.: 09/116,415

[22] Filed: Jul. 16, 1998

Related U.S. Application Data

[60] Provisional application No. 60/052,954, Jul. 17, 1997.

[51] Int. Cl.[7] ..... F41H 5/02

[52] U.S. Cl. ..... 89/36.02; 89/36.07

[58] Field of Search ..... 89/36.01, 36.02, 89/36.07; 109/49.5

[56] References Cited

U.S. PATENT DOCUMENTS

| | | | |
|---|---|---|---|
| 383,752 | 5/1888 | Milligan | 89/36.07 |
| 1,083,846 | 1/1914 | Markson | 109/9 |
| 1,202,402 | 10/1916 | Meaden et al. | 52/264 |
| 2,317,392 | 4/1943 | Lord | 89/36.07 |
| 2,370,596 | 2/1945 | Wallace | 109/49.5 |
| 2,463,674 | 3/1949 | Bell, Jr. et al. | 294/68.1 |
| 3,075,252 | 1/1963 | King | 52/29 |
| 5,044,252 | 9/1991 | Gamadi et al. | 86/50 |

*Primary Examiner*—Stephen M. Johnson
*Attorney, Agent, or Firm*—Taylor & Aust, P.C.

[57] ABSTRACT

A portable, reusable combat bunker formed of rotationally molded hollow plastic modules temporarily joinable by wooden beams and metal brackets. In one form, there is a C-shaped base module and a rectangular cover or "ceiling" module. The modules are assembled at a site and at least partially filled with water or sand. When the bunker is to be moved to a new location, the water or sand is drained, the modules dissembled and moved. Double headed nails facilitate dissembly.

16 Claims, 8 Drawing Sheets

PORTABLE COMBAT BUNKER

CROSS REFERENCE TO RELATED APPLICATIONS

This is a non-provisional patent application based upon provisional application Ser. No. 60/052,954, entitled "PORTABLE COMBAT BUNKER", filed Jul. 17, 1997 now abandoned.

SUMMARY OF THE INVENTION

The present invention relates generally to a protective personnel enclosure for military and similar individuals. More especially, the present invention comprises a portable parapet or bunker structure having hollow sidewalls and top which may be filled with water, sand or similar material after being deployed at a selected site to enhance the safety of those occupying the structure. In particular, the present invention relates to a relatively easily moved walled enclosure capable of stopping bullets, shrapnel, grenade fragments and similar anti-personnel projectiles.

From the classic castle battlement to fox holes and bunkers, protective military personnel bulwarks are nearly as old as the art of warfare itself. The common feature of such personnel protective structures is their fixed location. Many military operations require the establishment of checkpoints the locations of which are more or less temporary and may change during the military operation. When attempting to make protective military personnel bulwark structures movable, motorized arrangements such as the common tank are generally resorted to. These motorized military vehicles, while well suited to their intended task, are quite expensive.

Among the several objects of the present invention may be noted the provision of a relatively economical portable personnel protective structure; the provision of a bunker from which personnel may easily fire a gun; the provision of a portable bunker which may be deployed at one site and thereafter moved to be redeployed at other locations; and the provision of a hollow rotationally molded parapet which may be filled with sand, water or similar material to enhance its projectile stopping capability after being deployed at a selected site. These as well as other objects and advantageous features of the present invention will be in part apparent and in part pointed out hereinafter.

Figure 1:
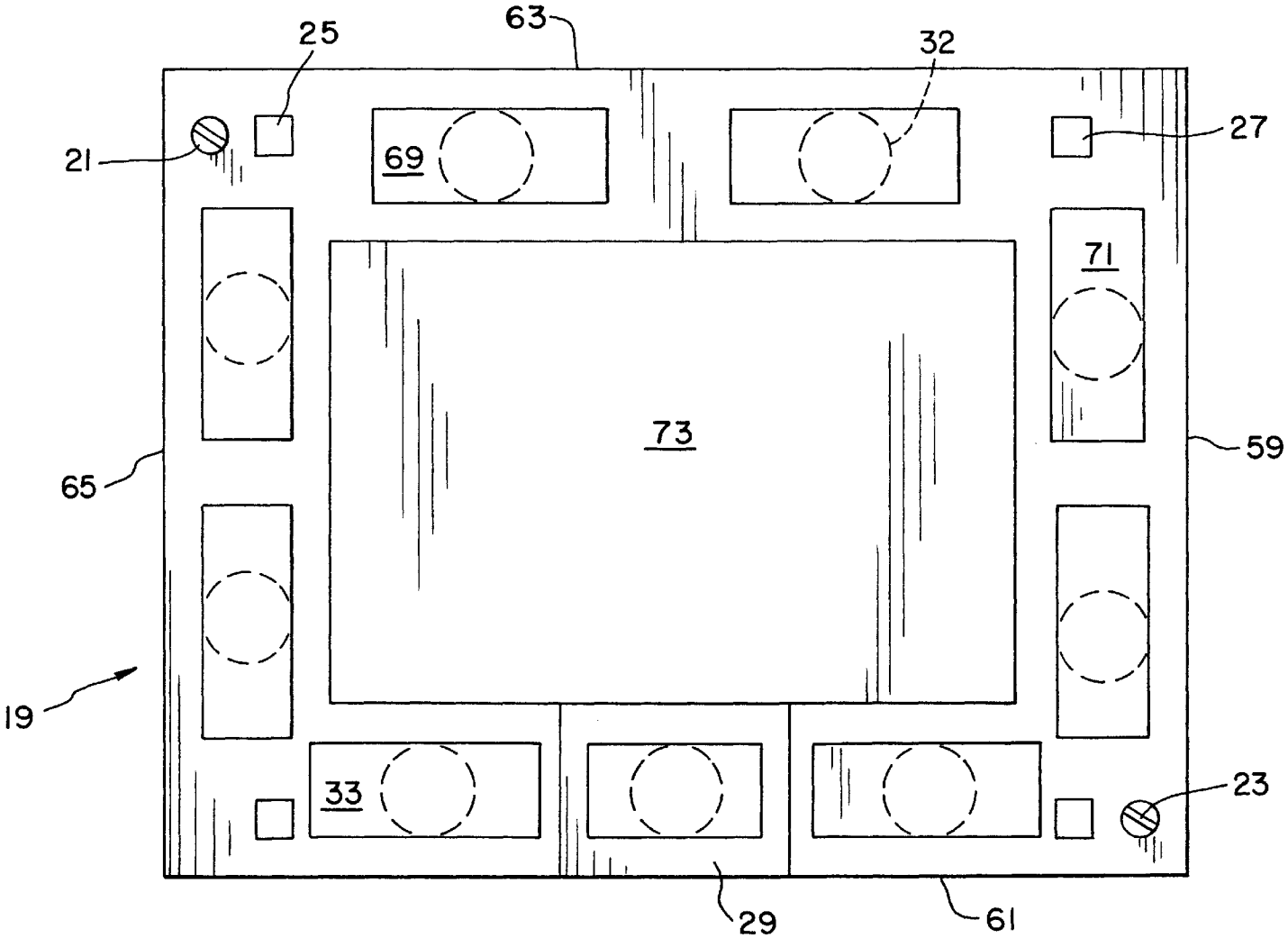
FIG. 1 is a top plan view of a bunker base module according to the invention in one form.

Corresponding reference characters indicate corresponding parts throughout the several views of the drawing. The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 2:
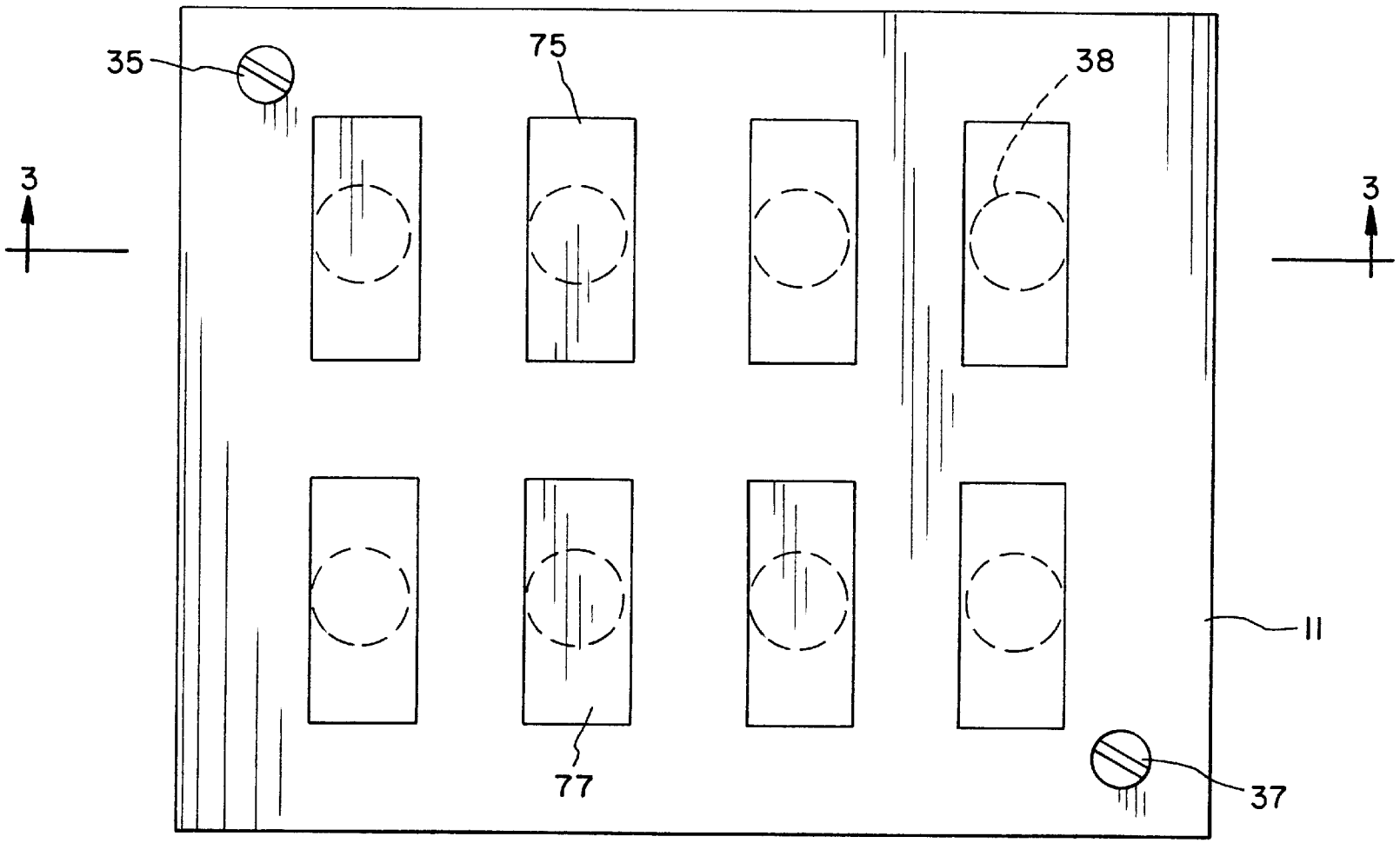
FIG. 2 is a top plan view of a cover module suitable for use with the base module of FIG. 1.
Figure 3:
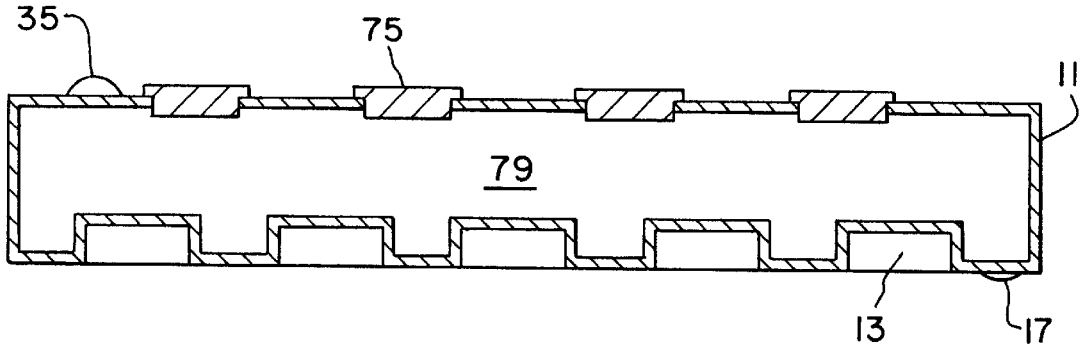
FIG. 3 is a cross-sectional view of the cover module of FIG. 2 along the lines 3—3.
Figure 4:
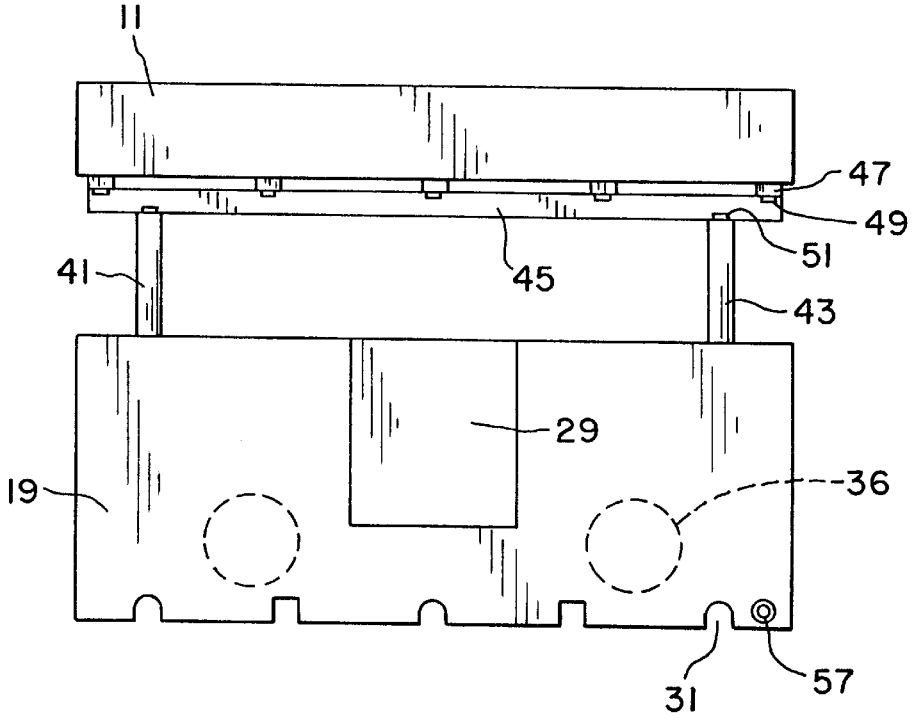
FIG. 4 is a rear elevation view of an assembled bunker.
Figure 5:
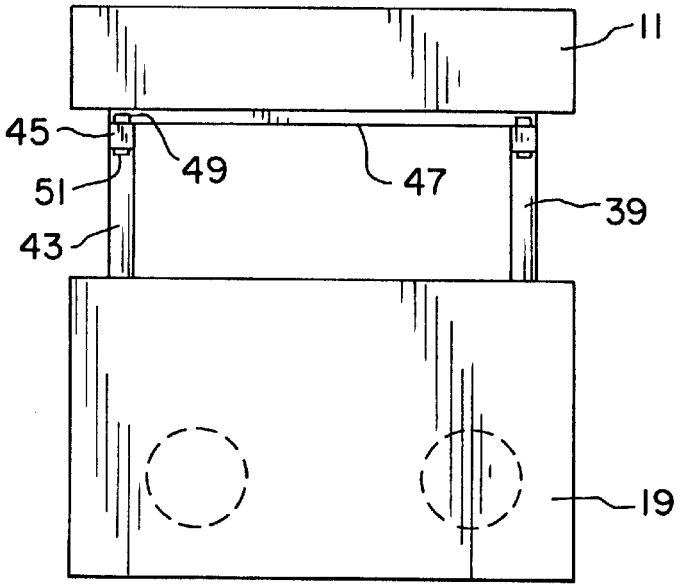
FIG. 5 is a side elevation view of the assembled bunker of FIG. 4 from the right side thereof.
Figure 6:
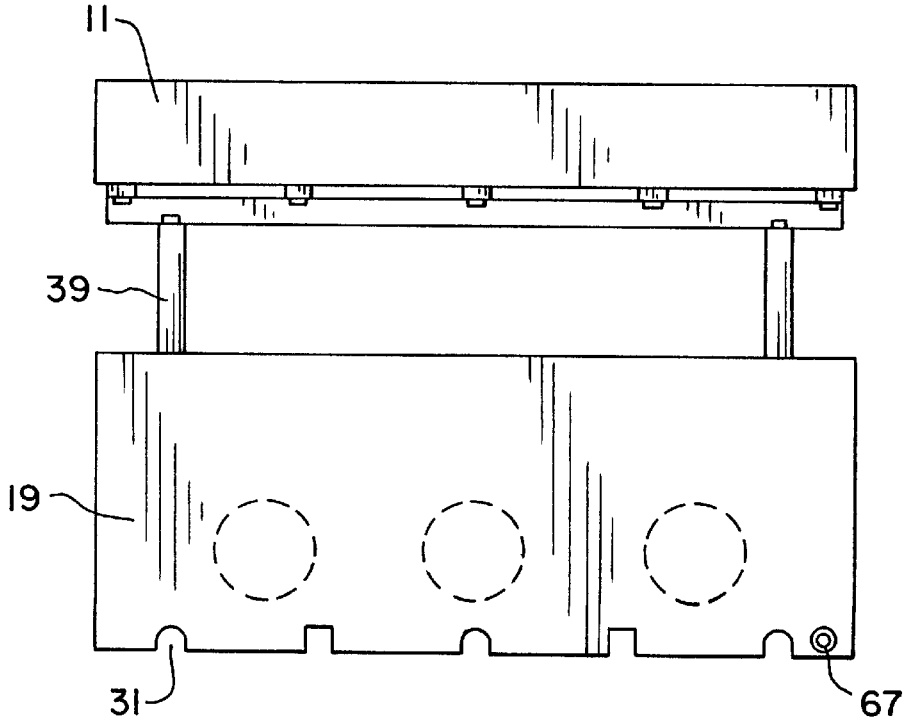
FIG. 6 is a front elevation view of the assembled bunker of FIGS. 4 and 5.
Figure 7:
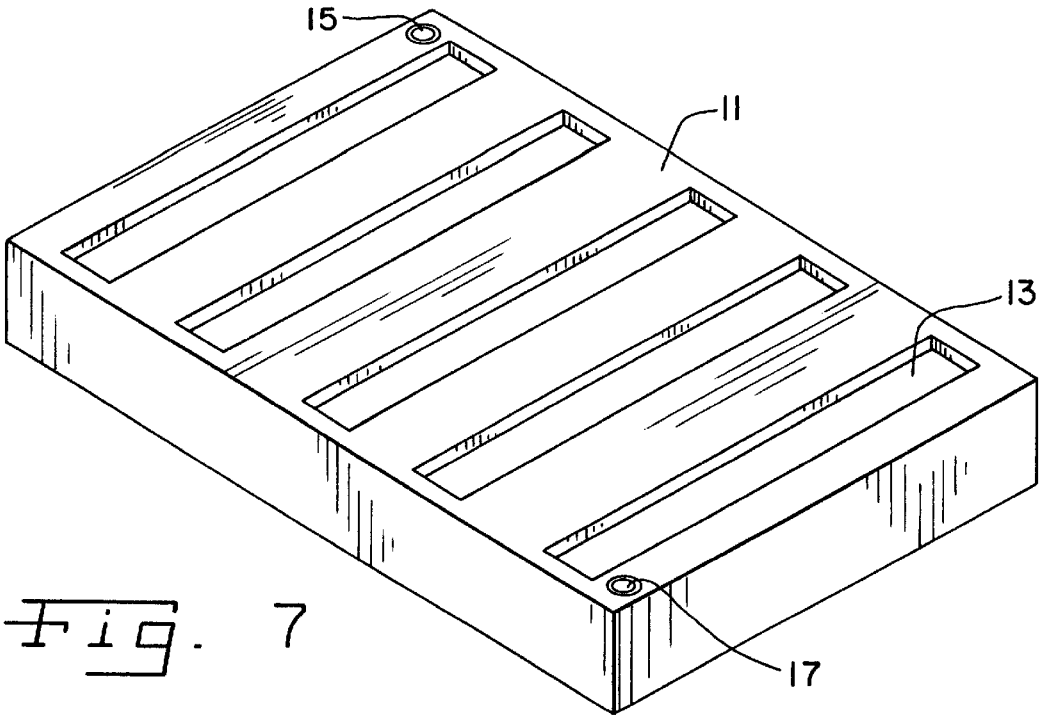
FIG. 7 is a perspective view of the cover module from beneath so that the five beam receiving depressions are visible.
Figure 8:
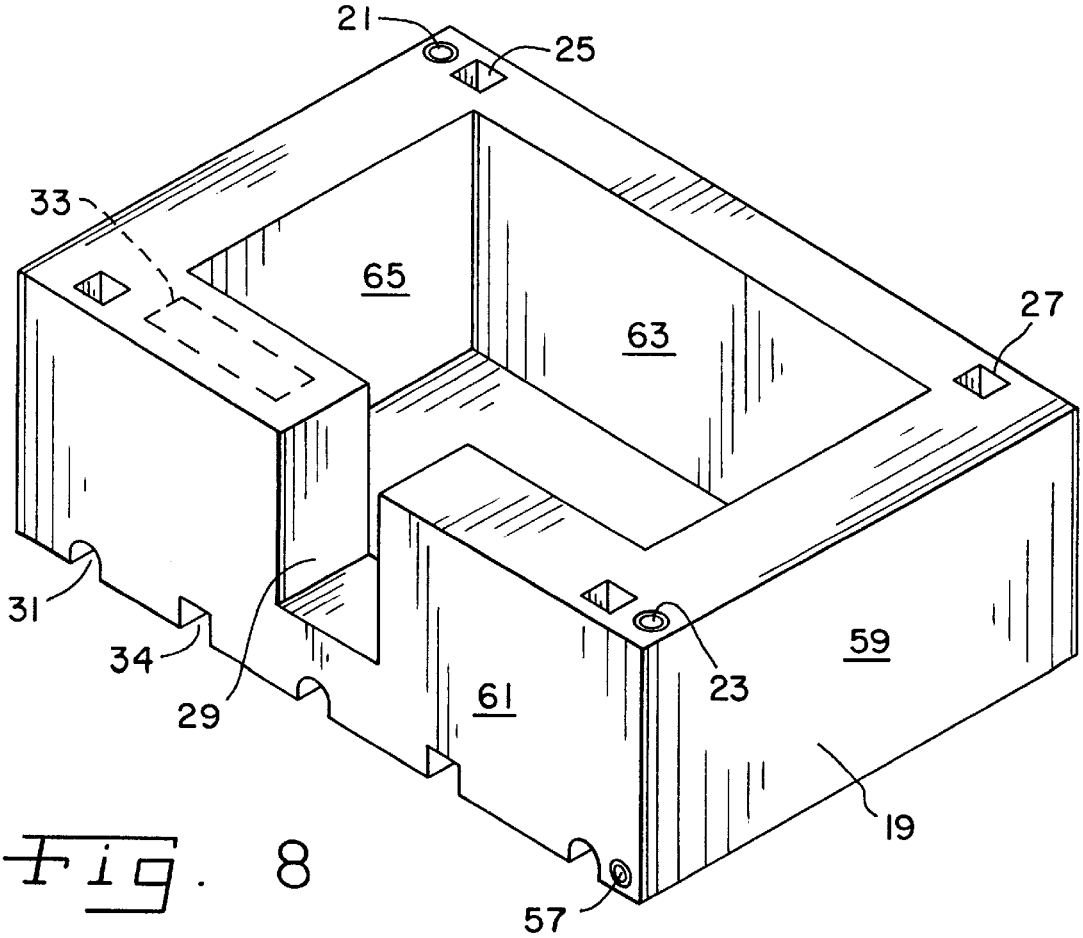
FIG. 8 is a perspective view of the base parapet module.
Figure 9:
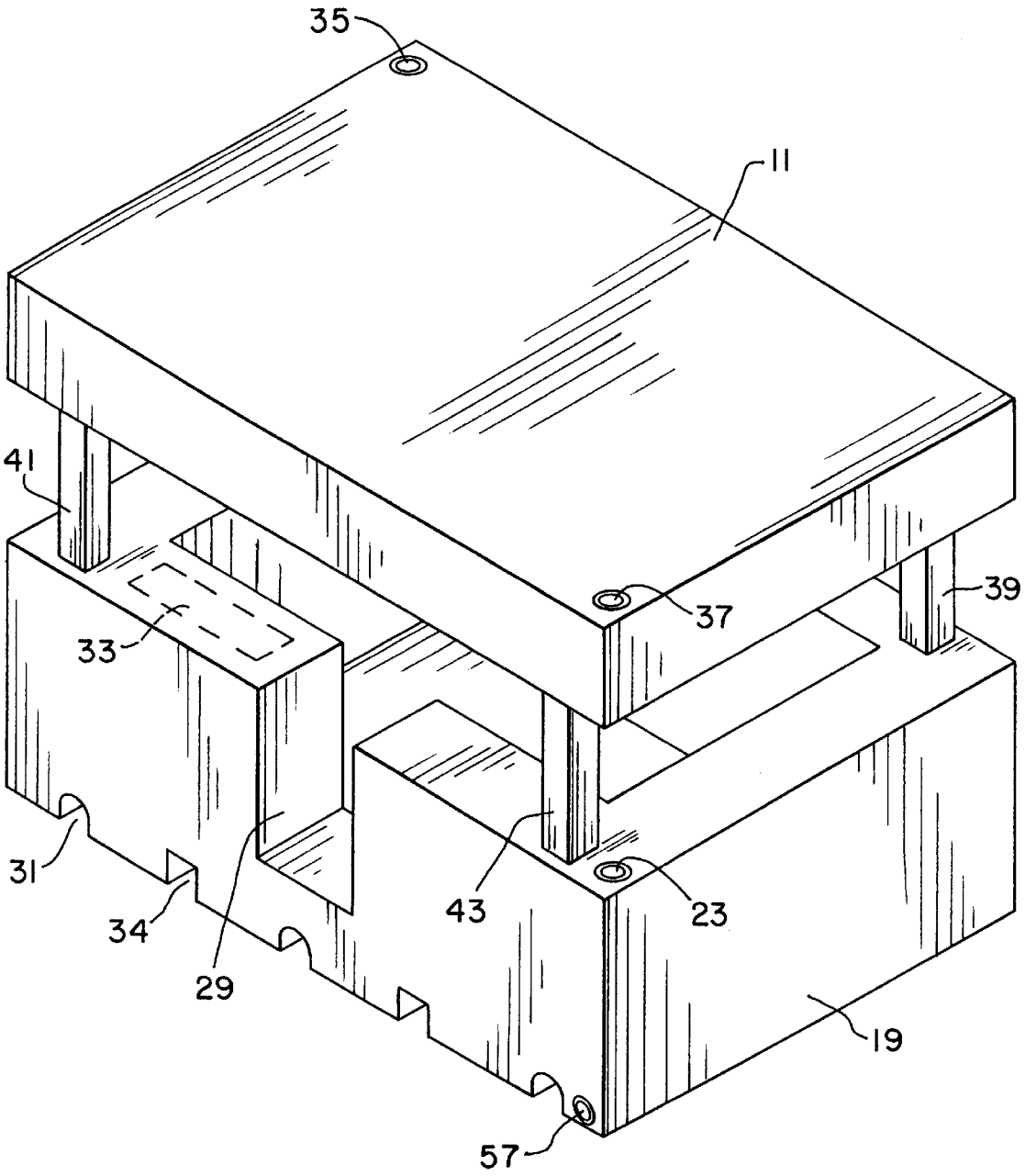
FIG. 9 is a perspective view of the cover and base parapet modules of FIGS. 7 and 8 assembled.

FIGS. 4, 5, 6 and 9 shows the assembled portable, reusable combat bunker which is formed of at least two temporarily joinable rotationally molded hollow plastic modules, a hollow rotationally molded base parapet module 19 shown separately in FIGS. 1 and 8, and a hollow rotationally molded cover module 11 shown separately in FIGS. 2, 3 and 7. Each of these modules has a hollow interior such as 79 which may be filled with sand, water or similar material by way of removable water fill plugs 35, 37, 21 and 23 or by way of sand fill ports such as 33, 69, 71, 75 and 77 to enhance its projectile stopping capability after being deployed at a selected site. Each module is provided with at least one sealable liquid fill hole 21, 23, 35 or 37 and at least one sealed liquid drain hole 15, 17, 57 and 67. Optionally, somewhat larger access ports such as 33, 69, 71, 75 and 77 may be provided for filling the modules with sand. The sand fill ports may be closed by lids such as illustrated in FIG. 3. Alternatively, commercially available "manways" (an internally threaded flange or ring with a removable externally threaded approximately 18 inch diameter lid) may be used as suggested by the dotted lines such as 32 and 38. Several such optional ports are illustrated in FIGS. 1, 2 and 3. It will be understood that the modules may be provided with water fill openings only, sand fill openings only, or with both. In some cases, the sand fill ports may initially be absent from the modules and then later be created by cutting away regions of the rotationally molded module when needed as suggested by the dotted lines of FIGS. 8 and 9.

The base parapet module 19 includes four vertically extending post receiving openings such as 25 and 27 for receiving four cover support posts such as 39, 41 and 43 each of which is disposed in and maintained in a vertical attitude by a corresponding post receiving opening so as to extend above the parapet. There are a plurality such as two main beams 45 each horizontally spanning and supported by at least a pair of support posts 39, 41 or 43, for example. There are further plurality such as five support beams 47 each horizontally spanning and supported by at least a pair of main beams 45. The support beams may be received in generally rectangular support beam receiving depressions or pockets 13 formed in the underside of the cover module as shown in FIGS. 3 and 7.

The combat bunker base parapet module 19 is formed of four generally orthogonal sidewall portions 59, 61, 63 and 65 and has a relatively narrow personnel access opening 29 in sidewall 61. There are a plurality of transverse openings such as 31 near the lowermost edge of the sidewalls 61 and 63 for receiving horizontal transport members to allow the base module to be carried by, for example, six people each holding one end of one of three carrying poles for transporting the module from one site to the next. Openings such as 34 for to accommodate a fork lift as well as other transporting techniques may be employed.

Figure 10:
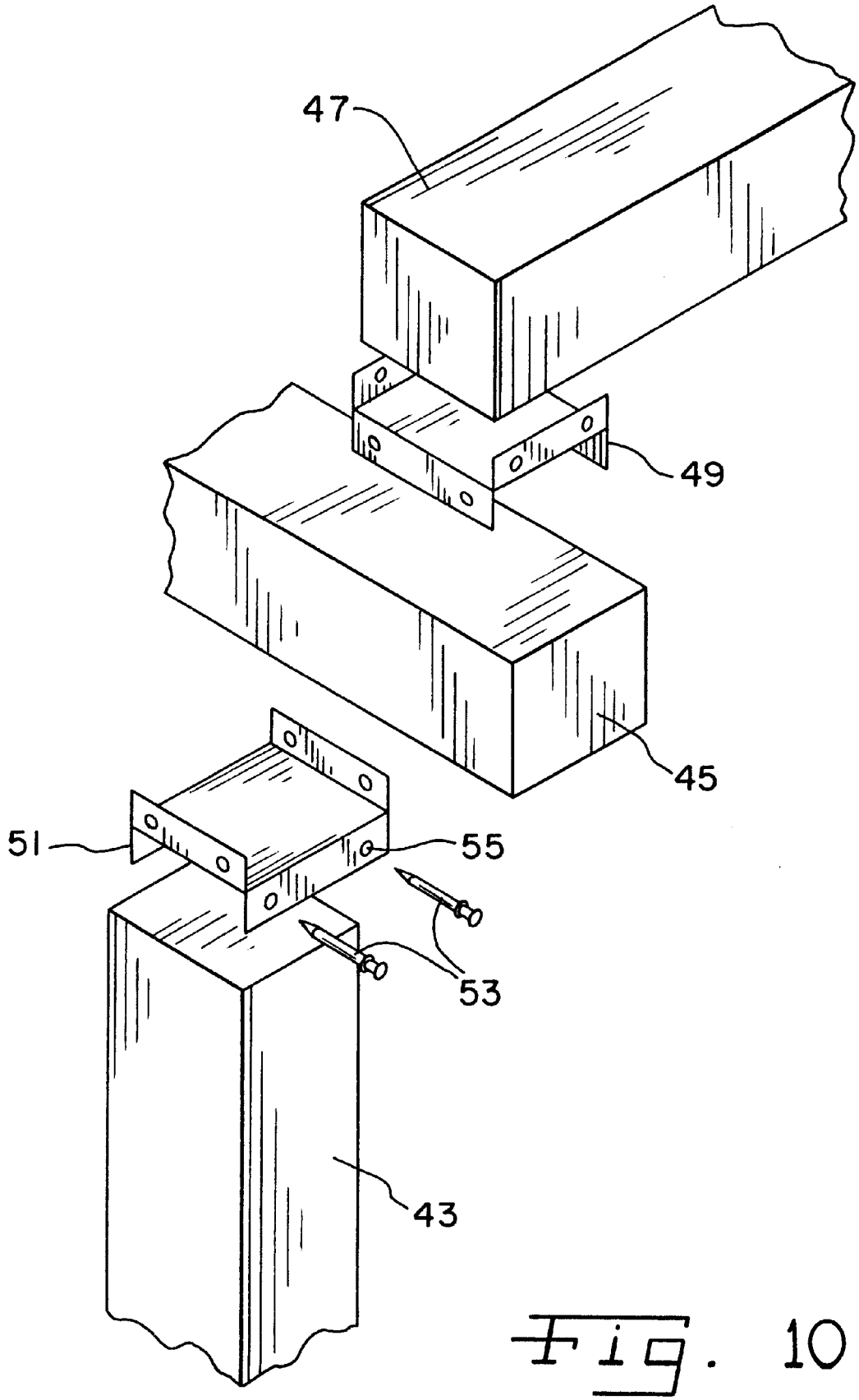
FIG. 10 is an exploded perspective view of a portions of a post, a main beam and a support beam to be joined to one another by two metal brackets and an illustrative double headed nail.

As best seen in FIG. 10, each main beam 45 is fastened to each of said at least pair of support posts 43 by a metal bracket 51 and a plurality of double headed nails 53 which pass through holes 55 in the metal bracket and into the corresponding main beam or support post. Similarly, each support beam 47 is fastened to each of the main beams 45 by a metal bracket 49 and a plurality of double headed nails passing through the metal bracket and into one of the main beam and the support beam.

Figure 11A:
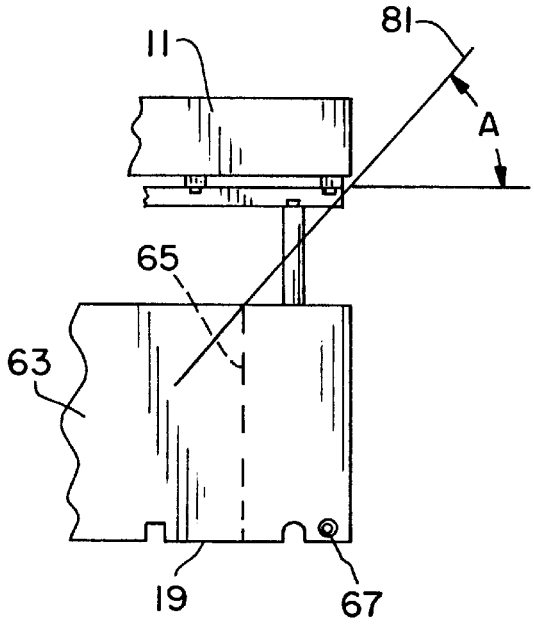
FIGS. 11*a* and 11*b* are comparative front elevation views of a portion of the assembled bunker illustrating a modification.
Figure 11B:
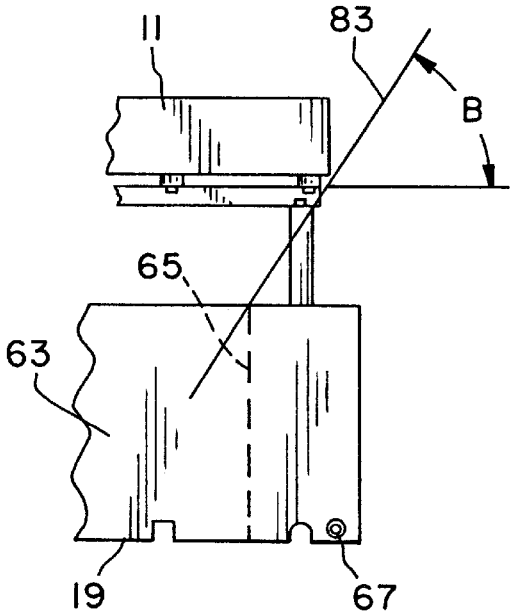
Figure 11C:
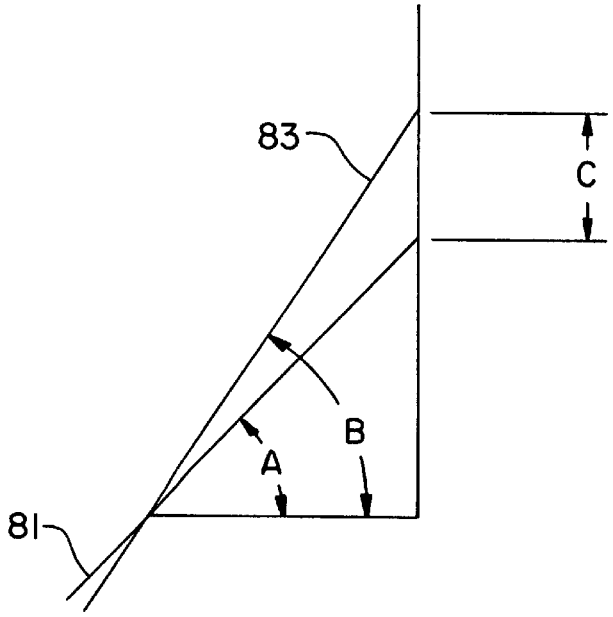
FIG. 11*c* illustrates the advantage of the modification of FIG. 11*b*.

As thus far discussed, the cover has been a rectangular parallelepiped having the same length and width as the base parapet module. Cover 11 may have at least one of its length and width less than the corresponding base dimension as shown in FIG. 11*b* to enhance the upward shooting angle from within the bunker. FIG. 11*a* is a reproduction of the right hand portion of FIG. 6 with the inside of side wall 65 shown in dotted lines. An occupant of the bunker could rest a rifle on the upper edge of the wall 65 and angle a shot upwardly along line 81 by a maximum of the angle A. In one preferred form, the sidewalls such as 65 were about eighteen inches thick. By shortening the top 11 by about six inches as shown in FIG. 11*b*, the occupant may now fire along line 83 at an upward angle B. This results in the rather substantial increase C in FIG. 11*c* of the upward vertical distance which the rifleman can cover from within the bunker. This increase is achieved without increasing the vertical distance between the sidewall and top and with minimal increase in the exposure of the occupant to hostile gunfire.

The method of deployment of the invention should now be clear. In addition to the base and cover modules, each bunker includes the following cover support members:

2—8 foot 4" by 4" wooden main beams such as 45.

4—7 foot 4" by 6" wooden vertical posts such as 39, 41, and 43.

5—6 foot 4" by 4" wooden support beams such as 47.

14—metal brackets such as 49 and 51.

112—double headed nails.

The empty base module is located where desired and the four vertical posts such as 39, 41 and 43 are placed upright in the openings such as 23, 25 and 27. The two main beams such as 45 are positioned on the four vertical posts and nailed in place with the metal brackets 51. The five support beams such as 47 are then positioned spanning the two main beams and the cover module 11 placed thereon. The modules are then filled with sand or water to a preferred level and the bunker is occupied. Of course, the base parapet module may be filled prior to erecting the posts if desired.

There follows technical data on an exemplary prototype unit:

Base 19 was 7 foot by 9 foot and 46" high. The base was rotationally molded from high density polyethylene to have a sidewall thickness of about ⅜". The base empty weight was 575 pounds and, when filled with water, weighed 9,680 pounds. This same base filled to its capacity of 1084 gallons with wet sand weighs nearly 18,000 pounds.

Cover 11 was slightly smaller than the base 19 to enhance the upward shooting angle while not detracting from the protection afforded the occupants. Cover 11 was 8'6" long, 6'6" wide and 18" high. The cover was also rotationally molded from high density polyethylene to have a sidewall thickness of about ⅜". The cover empty weight was 310 pounds and, when filled with water, weighed 5,383 pounds. This same cover filled to its capacity of 604 gallons with wet sand weighs almost 10,000 pounds.

In summary, the invention has a number of advantages over known prior bunkers. It is re-deployable a plurality of times at various locations. When drained, the modules are relatively light and easily movable, yet when filled, the modules provide adequate penetration preventing capability for most all small arms fire, hand grenades and small explosives.

From the foregoing, it is now apparent that a novel portable bunker arrangement has been disclosed meeting the objects and advantageous features set out hereinbefore as well as others, and that numerous modifications as to the precise shapes, configurations and details may be made by those having ordinary skill in the art. For example, the base parapet, cover or both may be formed from more than two modules. The bunker interior floor 73 may be molded integral with the base parapet module, may be a separate pallet-like insert or the base parapet may simply be C-shaped, floorless and rest on the ground. The bunker may be supplied with sand fill openings only, water fill openings only or a combination of both. Larger sidewall ports such as manways 36 for facilitating the removal of sand may be included. These and many other modifications may be made without departing from the spirit of the invention or the scope thereof as set out by the claims which follow.

What is claimed is:

1. A portable, reusable combat bunker formed of at least two temporarily joinable rotationally molded hollow plastic modules including a hollow rotationally molded base parapet module and a hollow rotationally molded cover module wherein each of said modules may be filled with sand or water to enhance its projectile stopping capability after being deployed at a selected site.

2. The combat bunker of claim 1 wherein the base parapet module includes at least four vertically extending post receiving openings, the bunker further including at least four cover support posts each disposed in a corresponding post receiving opening and extending above the base parapet module, a plurality of main beams each horizontally spanning and supported by at least a pair of said support posts, and a further plurality of support beams each horizontally spanning and supported by at least a pair of said main beams.

3. The combat bunker of claim 2 wherein the cover module rests directly on the support beams.

4. The combat bunker of claim 2 wherein each main beam is fastened to each of said at least pair of support posts by a metal bracket and a plurality of double headed nails passing through the metal bracket and into one of the main beams and the support post.

5. The combat bunker of claim 2 wherein each support beam is fastened to each of said at least pair of main beams by a metal bracket and a plurality of double headed nails passing through the metal bracket and into one of the main beams and the support beam.

6. The combat bunker of claim 2 wherein the cover module includes a plurality of generally rectangular support beam receiving depressions or pockets.

7. The combat bunker of claim 1 wherein each module is provided with at least one sealable liquid fill hole and at least one sealable liquid drain hole.

8. The combat bunker of claim 1 wherein the base parapet module is formed of four generally orthogonal sidewall portions and has a relatively narrow personnel access opening in one of the sidewalls.

9. The combat bunker of claim 8 wherein the cover is a generally rectangular parallelepiped having at least one of its length and width less than the corresponding base dimension to enhance the upward shooting angle from within the bunker.

10. The combat bunker of claim 1 wherein the base parapet module includes a plurality of transverse openings near the lowermost edge thereof for receiving horizontal transport members for transporting the module from one site to the next.

11. The combat bunker of claim 1 wherein the hollow rotationally molded base parapet module and the hollow rotationally molded cover module are formed of a high density polyethylene having a sidewall thickness of about ⅜ inch.

12. The combat bunker of claim 1 wherein the hollow rotationally molded base parapet module periphery is generally rectangular and on the order of 7 feet wide and 9 feet long.

13. A portable, combat bunker formed of at least two temporarily joinable hollow modules including a hollow base parapet module and a hollow cover module, the base parapet module including at least four vertically extending post receiving openings, the bunker further including at least four cover support posts each disposed in a corresponding post receiving opening and extending above the base parapet module, a plurality of main beams each horizontally spanning and supported by at least a pair of said support posts, and a further plurality of support beams each horizontally spanning and supported by at least a pair of said main beams.

14. The portable combat bunker of claim 13 wherein each of said modules may be filled with sand or water to enhance its projectile stopping capability.

15. The portable combat bunker of claim of claim 13 wherein the base parapet module is formed of four generally orthogonal sidewall portions and has a relatively narrow personnel access opening in one of the sidewalls.

16. The portable combat bunker of claim 13 wherein the cover module includes a plurality of generally rectangular support beam receiving depressions or pockets and rests directly on the support beams.

* * * * *